US006978496B2

(12) United States Patent
Adrian

(10) Patent No.: US 6,978,496 B2
(45) Date of Patent: Dec. 27, 2005

(54) PORTABLE WATER HEATER

(75) Inventor: Trevor Adrian, Park City, UT (US)

(73) Assignee: Taph, LLC, Park City, UT (US)

( * ) Notice: Subject to any disclaimer, the term of this patent is extended or adjusted under 35 U.S.C. 154(b) by 31 days.

(21) Appl. No.: 10/216,496

(22) Filed: Aug. 9, 2002

(65) Prior Publication Data

US 2003/0097710 A1 May 29, 2003

Related U.S. Application Data

(60) Provisional application No. 60/311,731, filed on Aug. 10, 2001.

(51) Int. Cl.[7] ..... A47K 3/28
(52) U.S. Cl. ..... 4/598; 122/169
(58) Field of Search ..... 4/598, 599, 602, 4/603; 122/14.1, 14.2, 169; 126/344, 9 A

(56) References Cited

U.S. PATENT DOCUMENTS

| | | | | |
|---|---|---|---|---|
| 489,660 A | * | 1/1893 | Pellow | 126/359.1 |
| 913,832 A | * | 3/1909 | Lyon et al. | 122/14.31 |
| 969,714 A | * | 9/1910 | Meem | 122/167 |
| 1,957,365 A | * | 5/1934 | Stewart | 126/392.1 |
| 1,991,557 A | * | 2/1935 | Johnson | 122/14.1 |
| 2,567,506 A | * | 9/1951 | Bowman | 4/598 |
| 3,431,565 A | * | 3/1969 | Nelson | 4/598 |
| 3,709,198 A | | 1/1973 | Williams | |
| 3,738,351 A | | 6/1973 | Watts | |
| 3,768,458 A | | 10/1973 | Williams | |
| 3,925,828 A | | 12/1975 | Kim | |
| 3,939,503 A | | 2/1976 | Nazworth | |
| 4,453,280 A | | 6/1984 | Greenleaf | |
| 4,777,675 A | | 10/1988 | Letner | |
| 5,111,538 A | | 5/1992 | Chapman | |
| D337,815 S | | 7/1993 | Yoshida | |
| 5,251,345 A | | 10/1993 | Pechner | |
| 5,460,161 A | | 10/1995 | Englehart et al. | |
| 5,515,558 A | | 5/1996 | Dodge | |
| 5,911,520 A | | 6/1999 | Kenney | |
| 6,049,919 A | | 4/2000 | Roteman | |
| 6,059,143 A | | 5/2000 | Weir | |
| 6,098,214 A | | 8/2000 | Seiber | |
| 6,354,511 B1 | * | 3/2002 | Hardee | 237/19 |
| 6,430,760 B2 | * | 8/2002 | Johns | 4/598 |

FOREIGN PATENT DOCUMENTS

| | | |
|---|---|---|
| EP | 000107960 A1 | 5/1984 |
| JP | 401027521 A | 1/1989 |

* cited by examiner

*Primary Examiner*—Gregory L. Huson
*Assistant Examiner*—Huyen Le
(74) *Attorney, Agent, or Firm*—Workman Nydegger

(57) ABSTRACT

A portable hot water heater for use during camping, boating, hunting, hiking, fishing, backpacking, etc. The hot water heater advantageously efficiently and rapidly heats large quantities of water for hot showers, cooking and cleaning. The hot water heater includes a pump that can draw water from any suitable water source, a power source, a heating assembly that quickly and efficiently heats the water as it flows through the heating assembly. The heating assembly is attached to a shower head or other fixture.

35 Claims, 7 Drawing Sheets

PORTABLE WATER HEATER

CROSS-REFERENCE TO RELATED APPLICATIONS

This application claims the benefit of U.S. Provisional Application No. 60/311,731, filed Aug. 10, 2001 and entitled "Portable Water Heater," which is hereby incorporated by reference.

BACKGROUND OF THE INVENTION

1. Field of the Invention

The present invention generally relates to a portable water heater and, in particular, to a portable hot shower for use while camping, boating, hunting, hiking, fishing, backpacking, etc.

2. Description of Related Art

Various types of devices have been used for many centuries for heating water, but water heaters that are truly portable and easy to use are not readily available. For example, campers and other outdoor enthusiasts requiring hot water often use a fire or cook stove to heat a container of water. The time required to heat even a small amount of water is significant, for example, up to fifteen or twenty minutes to heat a gallon of water.

Portable showers and hot water heaters that can be used in a variety of situations and locations are also known and have been used for many years, but these conventional portable showers often do not provide adequate hot water. For example, in an attempt to keep such showers small and portable, relatively small heat sources have been used. Unfortunately, these small heat sources are usually not powerful enough to provide the desired supply of hot water. Gas powered devices, which provide a larger heat source, have traditionally not been used because of their size and bulk.

Additionally, conventional portable showers often used gravity to deliver the water to the individual taking a shower. The force of gravity, however, often does not provide adequate water pressure or sufficient force to deliver the water as a fine spray. In addition, gravity powered showers require the user to find a location above the head of the user to place a large reservoir of water, which typically contains about two gallons of water and weighs about twenty pounds. It is often difficult to find a sturdy location to place the reservoir of water, especially when camping in remote or desert locations. It can also be difficult and dangerous to lift the relatively heavy reservoir of water into the desired location. Conventional portable showers have also used pumps to increase water pressure, but these pumps often required a large power source that is heavy and awkward to carry over long distances.

Known portable showers often utilize a large container for holding the water. Typically, the water is heated within the container and a pump or gravity is used to supply the heated water from the container to the user. A significant drawback of these known portable showers is that the size of the container limits the amount of hot water available to the user. Thus, if more than one person wants to take a shower, each person must refill the container with cold water, and that water must be heated before that person can take a hot shower. Heating the reservoir of water often takes a significant amount of time, especially if a small heat source is being used. Additionally, these conventional portable showers heat all the water in the container at the same time, requiring a substantial amount of heat from the heat source and a large amount of time to heat all the water in the container. Thus, depending upon the size of the heat source and container, it can take up to thirty minutes or more to heat the water in the container for a hot shower. Disadvantageously, the heated water in the container, which is generally poorly insulated or not insulated at all, constantly loses heat, thereby prolonging the time required to heat the water for a hot shower.

Conventional portable showers are often not truly portable because they are heavy, awkward to carry, and include a plurality of parts that must be carefully assembled. In addition, conventional portable showers often require the user to assemble and erect a number of components before the shower can be used. Further, many of these known portable showers are expensive and require complex machinery to heat the water.

It is also known to use solar power for portable showers, but solar heated water is dependent on direct sunlight for heat. Thus, if direct sunlight is not available, for instance on a cloudy day, a hot shower is not available. Further, solar heated systems require sunlight for a large portion of the day in order to sufficiently heat the water. Disadvantageously, this often requires the user to stay in one location for an extended period of time while the water is being heated. Another drawback of solar heated systems is the water container is not typically insulated, which allows a large amount of heat loss through the container. Further, solar heated systems do not work efficiently in low ambient temperature environments.

BRIEF SUMMARY OF THE INVENTION

A need therefore exists for a portable water heater that is truly convenient to use and eliminates the above-described problems.

One aspect of the present invention is a portable water heater that allows the pleasure of hot showers to be taken at almost anytime and in almost any location. The portable hot shower can be used by a wide variety of people such as campers, outfitters, backpackers, horseback riders, hunters, rafters, bikers, mountain climbers and the like. The portable hot shower can also be used in many different locations such as in parks, cabins, recreational vehicles (RV's), boats, beaches, etc. Thus, the portable water heater can be used to provide hot showers virtually anywhere in the outdoors, in cabins without electrical power or water heaters, or wherever a hot shower is desired.

Another aspect of the portable water heater is it provides heated water very quickly and efficiently. For example, the portable water heater does not have to heat an entire reservoir or container of water before supplying hot water. In contrast, the portable heater heats the water as it flows to the user without being stored or held in a container or reservoir either while the water is heated or thereafter. Thus, the water has minimal heat loss between the time the water is heated and its use by the user.

In greater detail, the portable water heater includes an intake that allows liquids or fluids, such as water, to enter the device. A pump is desirably located on the intake side of the heater to draw water into the device and through a conduit to a heating assembly. The heating assembly includes a heat transfer conduit that allows the water to pass through the assembly and a heat source that heats the water as it flows through the heat transfer conduit. The heat transfer conduit may include an upwardly spiraled or horizontally coiled tube that allows heat from the heat source to rapidly and efficiently heat the water flowing through the tubing. The heat source includes a fuel burner assembly, such as a gas-powered burner, that is located near the heat transfer conduit to heat the water as it flows through the tubing in the assembly. The heated water exits the heating assembly through an exit and enters an outlet tube or conduit that directs the water to the showerhead or other suitable type of fixture.

The portable water heater preferably uses a high-efficiency heat source such as a propane-powered burner. A propane-powered burner can provide up to 10,000 BTUs, or more, to quickly and efficiently heat the water. Additionally, the coiled tubing of the heat transfer conduit is preferably arranged to maximize the surface area of the tubing that is exposed to the heat source. Maximizing this surface area allows a maximum amount of heat to be transferred to the water in a minimum amount of time and space. Further, the coiled tubing is preferably constructed from a material, such as copper, that facilitates the transfer of heat from the heat source to the water.

The portable water heater can provide a hot shower to a user in any location or setting, and it can be used in conjunction with a wide variety of water sources such as lakes, ponds, streams or rivers; culinary water supplies such as at houses, cabins or boats; or other external water sources. Significantly, the portable water heater can be used any time that hot water is desired, such as for showering, cooking and cleaning. Further, the portable water heater can be used in connection with other types of fluids or liquids that are desired to be heated quickly and efficiently.

The portable water heater is a truly portable, light-weight and compact device that can be easily transported and assembled. Desirably, the portable water heater includes a carrying case in which all the components of the system can be easily stored when not in use. Advantageously, the carrying case can also be used to store and contain water for the water heater, if desired, when the water heater is being used. The carrying case preferably includes a recessed handle and a removable lid. The removable lid includes a recessed portion that can support all or a portion of the water heater in a desired position. In particular, the recessed portion is configured to receive a fuel source, such as a pressurized propane gas cylinder, for the water heater. Desirably, the recessed portion holds the fuel source and at least a portion of the portable water heater in an upright position. Thus, the lid of the carrying case can be used to provide a sturdy and stable base for the water heater.

Another aspect of the portable water heater is it allows any suitable quantity of water to be quickly and efficiently heated. For example, the portable water heater may provide enough hot water for a single shower or for a number of showers taken in rapid succession one after another. Advantageously, because the portable water heater does not heat a reservoir or large container of water, the water heater does not waste energy by heating water that is not used immediately. Additionally, the portable water heater is more efficient than conventional water heaters because it does not store or hold heated water in a reservoir until it is used. In contrast, the portable water heater heats the water as it flows to the user. Thus, minimal amounts of heat are lost before the hot water is used, and only a minimal amount of heated water is not used immediately after being heated. Therefore, the portable water heater is very efficient because it only heats the amount of water needed by the user at any given time, and the hot water is used immediately after it is heated.

Yet another aspect of the portable water heater is it provides hot water within seconds of demand by the user. In particular, during operation the portable water heater draws water from the water source and heats it in the heating assembly. The water is then immediately used by the user. Thus, because the water is heated in the heating assembly as it flows to the user, the user does not have to wait for a reservoir or container of water to be heated.

Still another aspect of the portable water heater is the water heater supplies hot water continuously as long as the fuel source supplies fuel to the fuel burner assembly, the water source provides water to the intake and power is supplied to the pump. Thus, the portable water heater can continually supply hot water when these conditions are satisfied.

A further aspect of the portable water heater is the electrical power required by the pump can be provided by a variety of different sources. Preferably, a battery pack is used to provide electrical power to the pump. Advantageously, the battery pack can include rechargeable or replaceable batteries. Alternatively, electrical power can be supplied by any suitable external power source such as a car or recreational vehicle volt battery. Electrical power may also be supplied to the pump by a cigarette adaptor in a car or boat, or power from the cigarette adaptor may be used to recharge the battery.

Yet another aspect of the portable water heater is it can be used in conjunction with other suitable devices such as a privacy enclosure. The privacy enclosure allows a person to use the portable water heater as a shower within a closed environment. The portable water heater can also be used with a collapsible or adjustable pole to create a hand washer or it can supply water to a sink for cooking or cleaning.

The portable water heater is advantageously simple to assemble and disassemble. The water heater is also portable and lightweight because it has relatively few components and many of the components are constructed from light-weight materials such as plastic. The water heater is relatively easy to manufacture and assemble because it has relatively few parts, which significantly reduces manufacturing costs. The water heater is also rugged because it is constructed from durable materials and components that can withstand extended use in a wide variety of environments. Further, in contrast to conventional water heaters, the present water heater is truly portable and lightweight, allowing it to be readily used in a wide variety of situations and locations.

Significantly, the portable water heater is easy to operate by simply placing the intake in a water source, igniting the heat source and powering the pump. The portable water heater is also relatively easy to repair because of its few parts and a readily understandable design.

These and other aspects, features and advantages of the present invention will become more fully apparent from the following description of the preferred embodiments and appended claims.

BRIEF DESCRIPTION OF THE DRAWINGS

The appended drawings contain figures of preferred embodiments of the portable water heater, which illustrate some of the above-recited and other aspects, features and advantages of the present invention. It will be appreciated, however, that the illustrated drawings only illustrate preferred embodiments of the invention and are not to be considered limiting of its scope. The invention will be described and explained with additional specificity and detail through the following figures.

DETAILED DESCRIPTION OF THE PREFERRED EMBODIMENTS

The present invention involves a portable water heater that can be used to provide a hot shower in a variety of environments and locations. The principles of the present invention, however, are not limited to portable water heaters for hot showers. It will be understood that, in light of the present disclosure, the portable water heater can be successfully used in connection with other types of devices and uses, such as used for cooking and cleaning.

Additionally, to assist in the description of the portable water heater, words such as top, bottom, front, rear, right and left are used to describe the accompanying figures. It will be appreciated, however, that the portable water heater can be located in a variety of desired positions including various angles, slopes and inclines. A detailed description of the portable water heater now follows.

Figure 1:
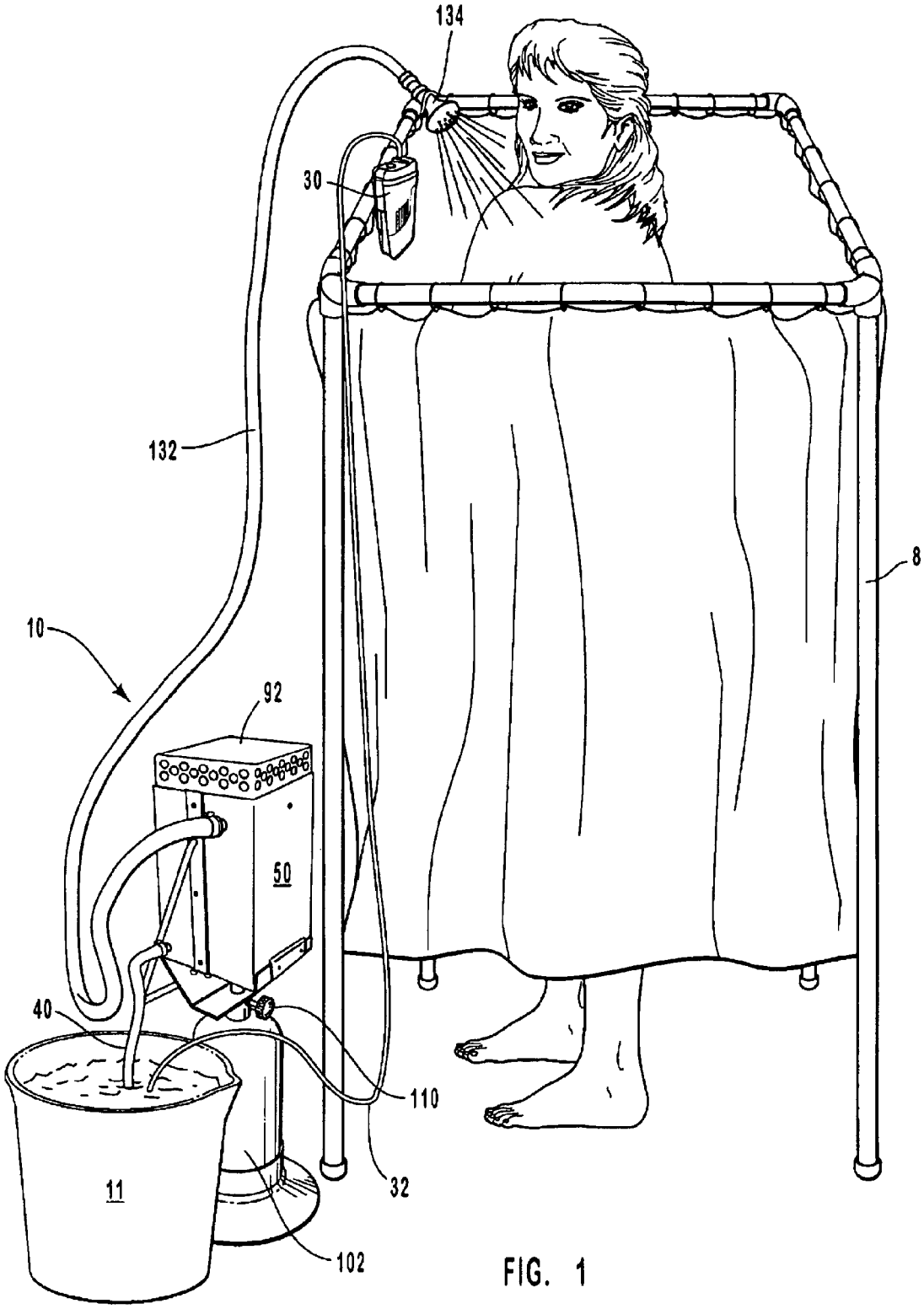
FIG. 1 illustrates a perspective view of one embodiment of the portable water heater, illustrating the portable water heater being used as a shower.

As seen in FIG. 1, a portable water heater 10 can be used to provide a hot shower to a user in a variety of locations. For example, portable water heater 10 allows a user to take a hot shower while camping, hiking, climbing, backpacking, etc. The shower can be used in conjunction with a privacy enclosure 8, if so desired. Alternatively, portable water heater 10 can be used any time hot water is desired, such as for cooking and cleaning.

Figure 2:
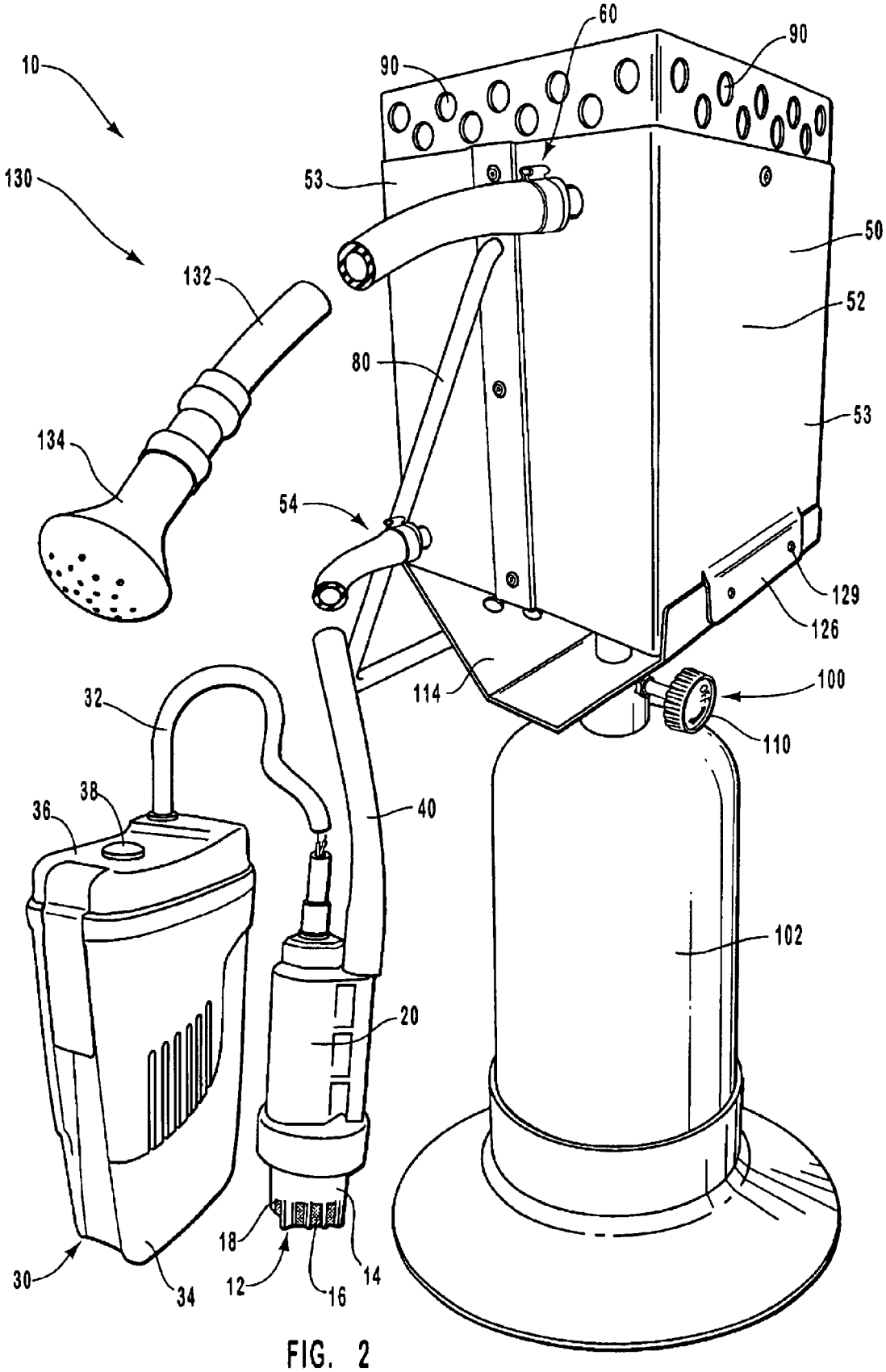
FIG. 2 is a partially exploded perspective view of the portable water heater shown in FIG. 1.

FIG. 1 depicts one embodiment of portable water heater 10 which includes a power supply 30 and heating assembly 50. A pump 20 (not shown) is disposed in a water source 11. As seen in FIG. 2, pump 20 includes an intake 12 that allows water or other suitable types of fluids from water source 11 to enter the device. Intake 12 desirably includes a removable cover 14 with a series of openings 16 to allow the water to enter pump 20. Intake 12 may also include a filter 18 that prevents foreign objects or other unwanted debris from entering the device. Advantageously, in one embodiment, cover 14 is threadably connected to intake 12 of pump 20 such that cover 14 can be removed and cleaned, and this also allows intake 12 to be directly connected to a water source such as a hose. It will be appreciated that cover 14 could also be attached using a snap fit or various other methods of retaining cover 14 on pump 20 which are known in the art.

As shown in FIGS. 1 and 2, pump 20 is disposed in water source 11 to draw water into portable water heater 10. In one embodiment, pump 20 is encased in a durable material such as plastic to protect it from damage, and to allow pump 20 to be submerged in water. The design and configuration of intake 12 and pump 20 allow portable water heater 10 to be used in a wide variety of locations and environments because intake 12 and pump 20 can simply be inserted into any suitable water source 11, such as a lake, stream, pond or river. Advantageously, intake 12 and pump 20 can also be used in connection with other types of water sources 11, such as a culinary water supply, water container or reservoir.

Pump 20 is preferably sized and configured to supply a sufficient volume of water for bathing or showering. One skilled in the art will appreciate that the volume of water delivered by pump 20 is dependent upon factors such as the size and speed of the pump. Thus, those skilled in the art will understand that the size and speed of pump 20, for example, may be varied depending upon the intended use of portable water heater 10. That is, pump 20 may be differently sized or configured if portable water heater 10 is intended to be used for showering or for cooking. Additionally, although in one embodiment pump 20 is depicted as being located near or formed in conjunction with intake 12, pump 20 could be located in any suitable location or portion of water heater 10 and still perform the function thereof with intake 12 being a separate member located remote from pump 20.

Power supply 30 is electrically connected to pump 20 by an electrical line 32. As shown in FIG. 2, power supply 30 includes a container 34 with a lid 36 and an on/off switch 38 for selectively controlling the flow of power to pump 20. In one embodiment, lid 36 is movingly attached to container 34. It will be appreciated that lid 36 could be attached to container 34 by hinges or by a resilient material that allows lid 36 to be selectively attached to container 34. Further, lid 36 and or container 34 of power supply 30 may include one or more inwardly extending bumps or protrusions that engage the lid 36. In another embodiment, lid 36 could by selectively attached to container 34 by a sliding arrangement formed on both lid 36 and container 34 such that when lid 36 is slidingly mounted on container 34 it cooperates therewith to removably lock in place. One skilled in the art will appreciate that various methods of moveably attaching or fasting lid 36 to container 34 may be utilized.

Power supply 30 may include batteries. In one embodiment illustrated in FIG. 2, power supply 30 uses multiple "D" sized batteries (not shown) that are inserted into container 34 to supply power to pump 30. More specifically, in one embodiment, power supply 30 includes four "D" sized batteries. It will be appreciated that depending on the size of power supply 30 and amount of water to be heated by portable water heater 10, various other numbers, sizes, and/or types of batteries may be utilized. The batteries used in power supply 30 may be replaceable or rechargeable, or power supply 30 may comprise a sealed battery. It will be appreciated that power provided by power supply 30 may vary according to the size and power requirements of pump 20. For example, a larger power supply 30 may be required for a larger pump 20 while a smaller power supply may be used with a smaller pump. Additionally, power may also be supplied by any suitable power source such as a car, recreational vehicle or boat battery, a cigarette lighter in a car or boat, connection to an electrical outlet or power grid, gasoline powered or other type of auxiliary motor, or the like.

As depicted in FIG. 1, intake 12 and pump 20 are in fluid communication with an intake tube 40. In one embodiment, intake tube 40 is constructed from a resilient flexible material and allows the water to flow directly from pump 20 to a heating assembly 50. Advantageously, pump 20 provides pressurized water for the user and, when portable water heater 10 is being used in conjunction with a shower, the force of gravity is not required to cause the water to flow from water source 11 to a showerhead 134. In contrast, many conventional portable showers require the user to place a heavy reservoir of water above the individual using the shower and then use the force of gravity to cause the water to flow to showerhead 134.

Figure 7:
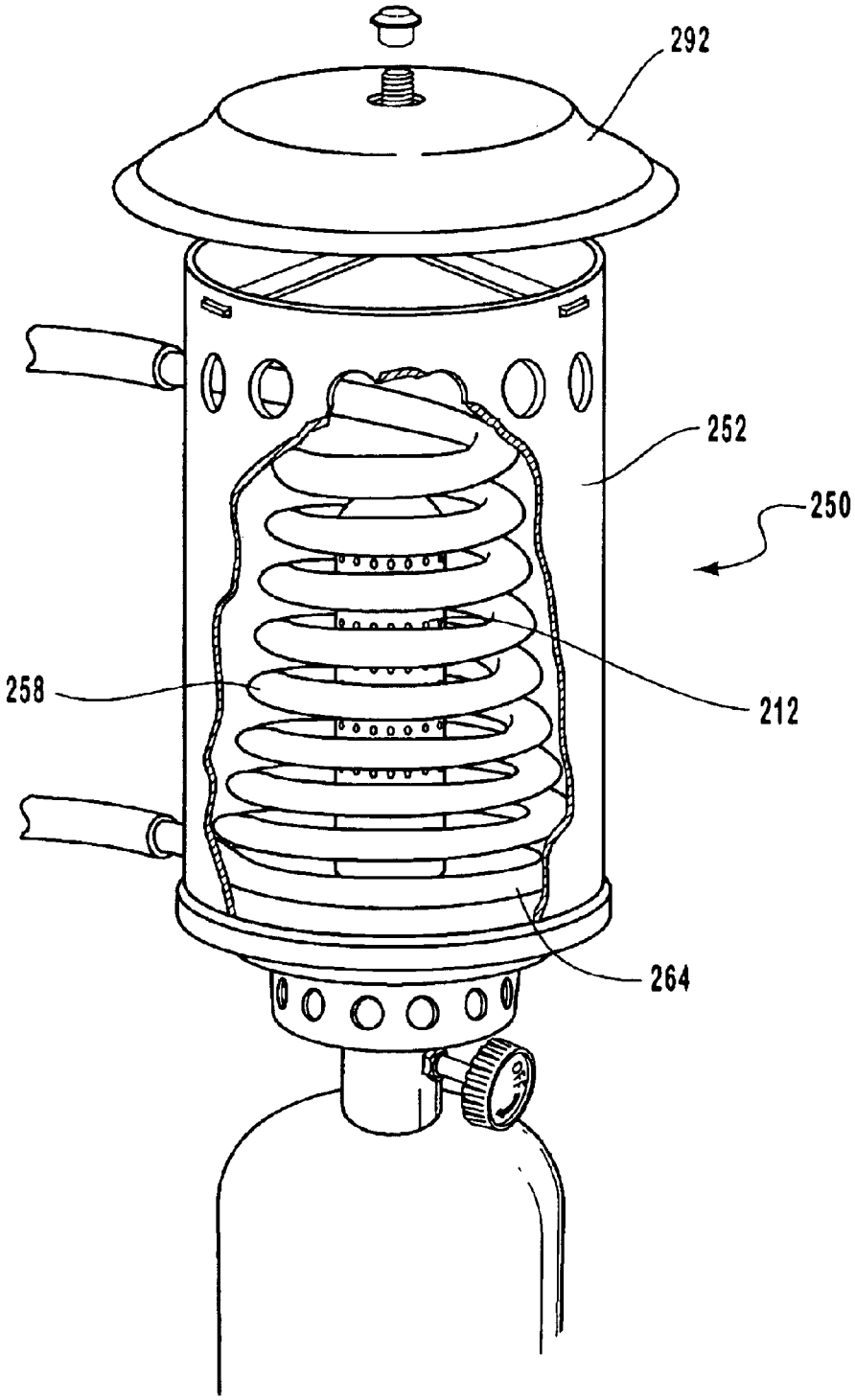
FIG. 7 is a partial perspective view of another embodiment of a heating assembly.

In one embodiment depicted in FIG. 2, heating assembly 50 of portable heater 10 includes a housing 52. In this embodiment, housing 52 includes four sidewalls 53 and has a generally rectangular configuration. In one embodiment, housing 52 has a length and a width of about five inches and a height of about six inches, but it will be understood that housing 52 may have any desired size depending upon various factors such as the rate at which water is to be heated. It will be appreciated that housing 52 could have various other numbers of sidewalls 53 and still perform the function thereof. In addition, it will be appreciated that housing 52 could have various other configurations and perform the function thereof. By way of example and not limitation, housing 52 could be square, cylindrical, oval, elliptical, and the like or combinations thereof. For example, FIG. 7 illustrates another embodiment of heating assembly 250 where housing 252 has by way of example and not limitation a generally cylindrical configuration.

Figure 4:
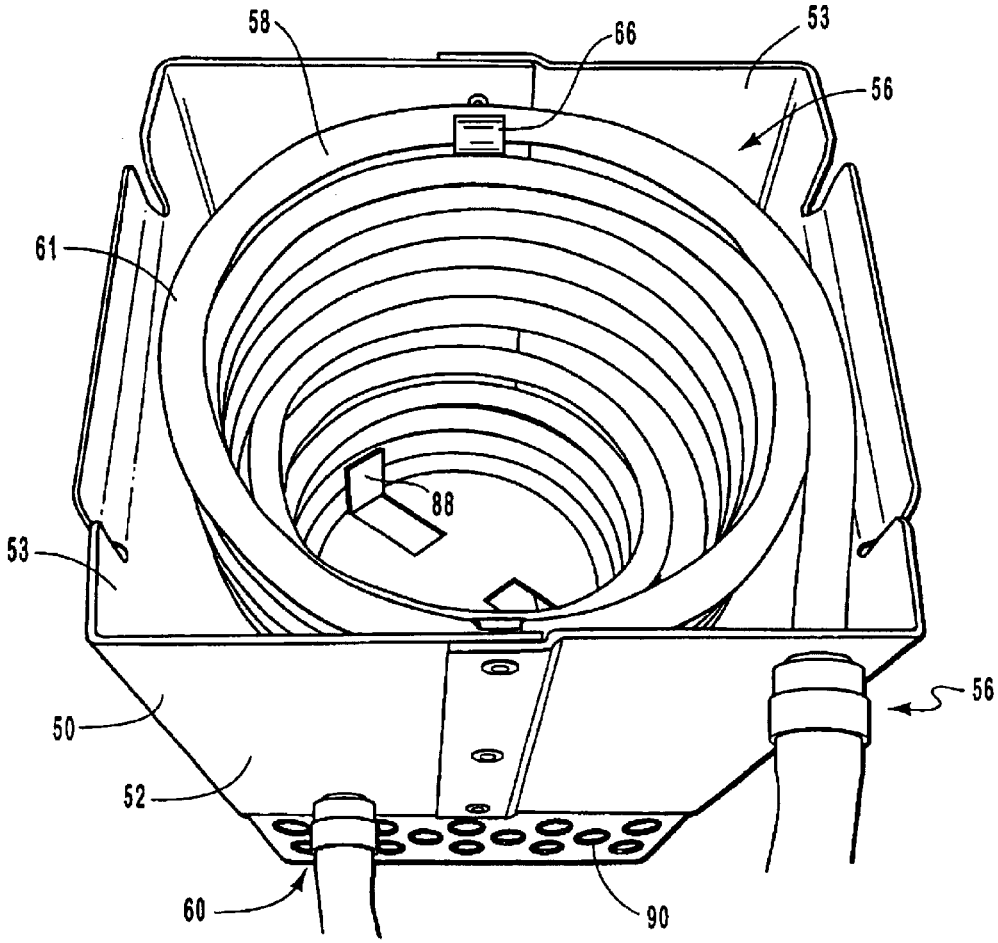
FIG. 4 is a perspective view from the bottom and looking toward the top of a portion of the portable water heater shown in FIG. 1, illustrating one embodiment of a heating assembly.
Figure 5:
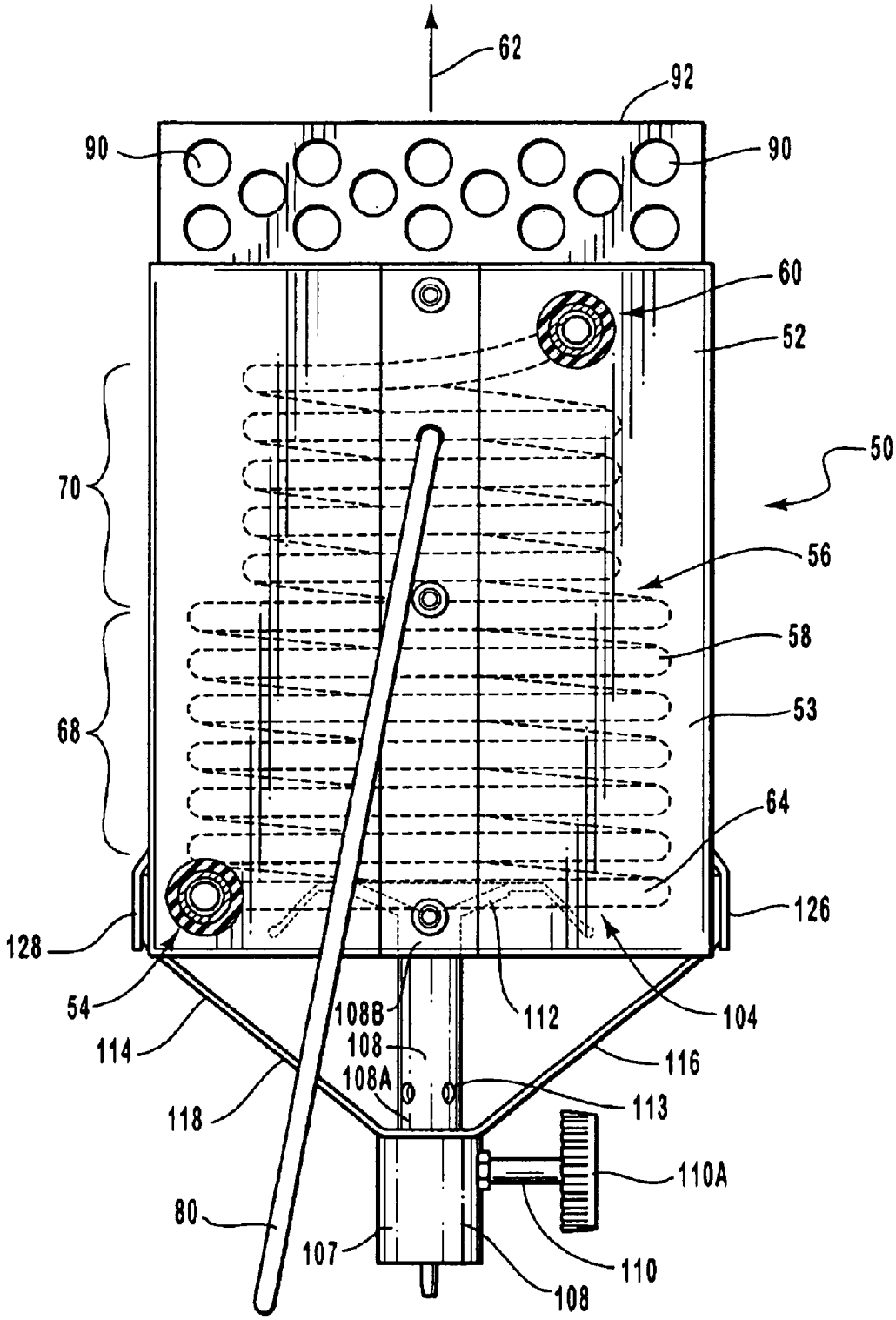
FIG. 5 is a side view of a portion of the portable water heater shown in FIG. 1, illustrating a one embodiment of a heating assembly and one embodiment of a fuel burner assembly.
Figure 6:
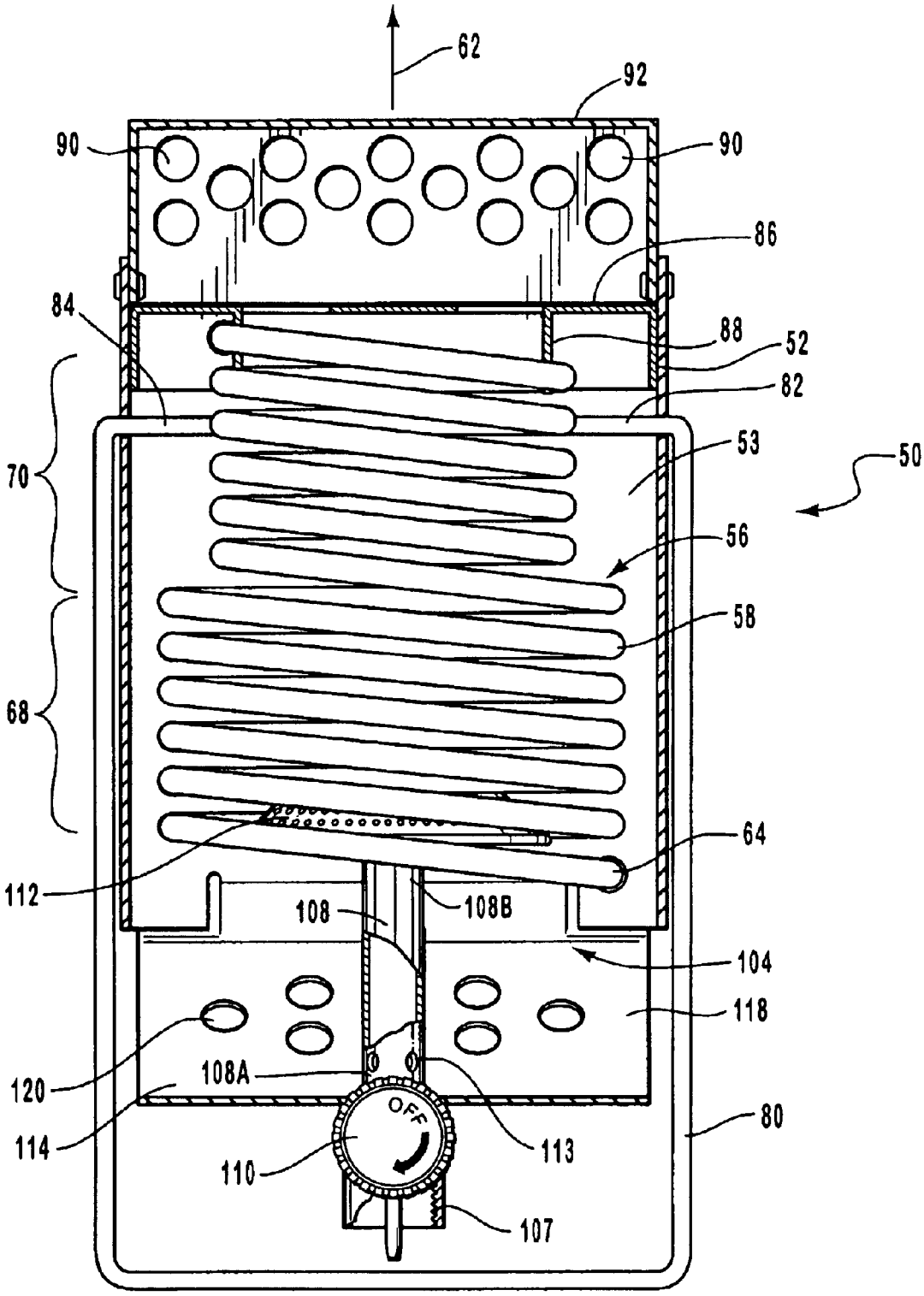
FIG. 6 is a partial cross sectional side view of the portion of the portable water heater shown in FIG. 5.

As illustrated in FIGS. 1 and 2, in one embodiment heating assembly 50 also includes an inlet 54 that is disposed on one side of housing 52 and it is connected to intake tube 40. Inlet 54 allows the water to flow into a heat transfer conduit 56 (see FIG. 4) disposed inside housing 52. As shown in FIGS. 4–6, in one embodiment heat transfer conduit 56 includes an elongated coiled tube 58 that spirals upwardly within housing 52 towards an outlet 60.

Portable water heater 10 also comprises a heat transfer means for transferring the heat produced by fuel burner 112 to water flowing through heat transfer means. One example of structure capable of performing the function of such a heat transfer means includes heating assembly 50. In one embodiment, heating assembly 50 comprises heat conduit 56 disposed in housing 52. It will be appreciated various other embodiments of structure are capable of performing the function of such a heat transfer means.

In one embodiment shown in FIG. 4, tube 58 includes a plurality of closely spaced coils having one or more different diameters D relative to the longitudinal axis of heat transfer conduit 56 that decrease in length as tube spirals upwardly. In one embodiment, decrease in diameter D of the coils results in heat transfer conduit 56 having a conical-like shape. More specifically, in one embodiment illustrated in FIGS. 4–6, coiled tubing 58 of heat transfer conduit 56 is generally disposed about a generally centrally located vertical axis 62 within housing 52. A first coil 64 is located proximate the lower end of housing 52 and is attached to sidewalls 53 of housing 52 by bracket 66. In one two brackets 66 are used to attache first coil 64 to the lower end of housing 52. It will also be appreciated that various other numbers of brackets 66 may be used to carry out the function thereof Brackets 66 hold tubing 58 of first coil 64 in a generally stationary position, but may allow some amount of movement, such as expanding movement, for example, while the water is heated as it flows through portable water heater 10. It will be appreciated that various types of fastening or connecting methods could be used to generally keep tubing 58 of first coil 64 in place with respect to housing 52.

In one embodiment, first coil 64 has an inside diameter such that the outer portion of coil 64 is disposed proximate, or actually touches, sidewalls 53 of housing 52. In one embodiment depicted in FIGS. 5 and 6, first coil 64 is part of a first series of coils 68 that spiral generally upwardly. This first set of coils 68 in one possible embodiment has an inside diameter X that is about four inches or smaller.

In one embodiment shown in FIGS. 5 and 6, coiled tubing 58 of heat transfer conduit 56 also includes a second set of coils 70 that have an inside diameter Y that is smaller than the inside diameter X of the first set of coils 68. In one embodiment, second set of coils 70 have an inside diameter Y of about three inches, but one skilled in the art will appreciate that second set of coils 68 may have any suitable diameter depending, for example, upon the size of housing 52, the rate at which water is to be heated or the diameter of the tubing. It will be appreciated that heat transfer conduit 56 could have various other configurations and perform the function thereof. For example, first set 68 and second set 70 of coiled tubing could be each in the shape of two cylindrical portions joined together. Alternatively, first set 68 and second set 70 of coiled tubing 58 could be configured to form a conical shape or two conical shapes that are joined together. In addition, by way of example and not limitation, first set 68 and second set 70 coiled tubing 58 of heat transfer conduit 56 could be reversed.

FIG. 7 depicts another embodiment of heating assembly 250 which includes another possible embodiment of coiled tubing 258. As seen in FIG. 7, in this embodiment coiled tubing 258 has a generally conical shape. By way of example and not limitation, coiled tubing 258 has a generally conical shape with a generally decreasing radius. As illustrated, coiled tubing 258 has generally constantly decreasing radius. It will be appreciated that various other configurations of coiled tubing 258 are capable of performing the function thereof. Further, it will be appreciated that coiled tubing 258 may have any suitable radius depending, for example, upon the size of the housing 252, the volume of water to be heated or the diameter of the tubing.

Figure 8:
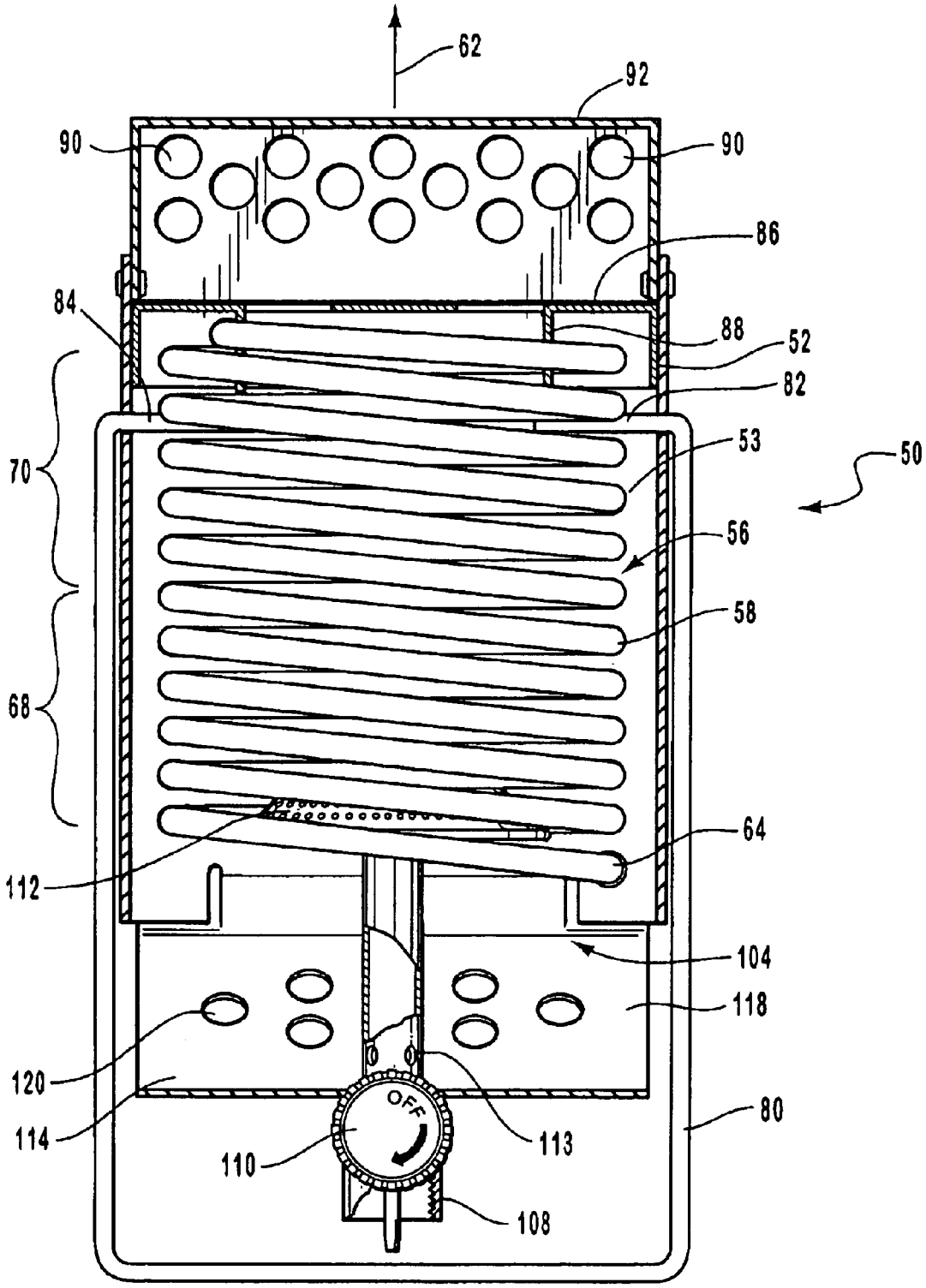
FIG. 8 is a partial cross sectional side view of a portion of the portable water heater shown in FIG. 6, illustrating another possible embodiment of a heating assembly.

FIG. 8 depicts another embodiment of heat transfer conduit 56 for heating assembly 50 of a portable water heater 10. As illustrated, heat transfer conduit 56 includes coiled tubing 58 in a generally cylindrical shape with substantially only one diameter Z. In other words, heat transfer conduit 56 is substantially all the same diameter Z.

In the various configurations for heat transfer conduit 56, coiled tubing 58 is sized and positioned to efficiently heat the water passing there through. In particular, heat transfer conduit 56 is configured to effectively and efficiently heat the water as it flows to the shower. For example, the individual coils of the tubing 58 are preferably spaced apart to allow air to flow around the tubes. This space between the coils allows the entire outer surface of the coil to be heated, thereby increasing the efficiency of portable heater 10. However, the coils of tubing 58 are still spaced close enough to each other to allow heat from one coil to be transferred to an adjacent coil to further increase the efficiency of portable water heater 10.

In one embodiment, coiled tubing 58 is spaced apart by a distance of about 0.25 inches to about 0.125 inches. However, it will be appreciated by one skilled in the art that various other suitable distances may be used to separate the coils. One skilled in the art will appreciate that coiled tubing 58 may also be divided into various other numbers of series of coils and that the coils or series of coils may have any suitable diameters. By way of example and not limitation, one skilled in the art will appreciate that coiled tubing 58 might alternatively be divided into three or more series of coils and perform the function thereof.

In addition, one skilled in the art will appreciate that one or more of the adjacent coils of coiled tubing 58 may touch one another and still perform the function thereof. Further, it will be appreciated that coiled tubing 58 may have other suitable arrangements and configurations, such as conical that are appropriate for the intended use of portable water heater 10.

In one embodiment, coiled tubing 58 is constructed from a material, such as copper, that facilitates rapid heat transfer. It will be appreciated by one skilled in the art that various other suitable types of materials including other metals, such as aluminum or stainless steel, May also be used. Additionally, in one embodiment, coiled tubing 58 extends generally from the lower portion of housing 52 to the upper portion of housing such that the tubing generally fills the heating assembly 50. This configuration advantageously increases the heat transfer achieved by heat transfer conduit 56 by providing a large amount of surface area of coiled tubing 58 while simultaneously minimizing the size of the housing 52.

As shown in FIG. 2, a handle 80 is attached to housing 52 of heating assembly 50 to facilitate carrying of portable water heater 10. Handle 80 is in one embodiment pivotally attached to housing 52 and allows heating assembly 50 to be attached to a support if desired. FIGS. 5 and 6 illustrate in further detail that in one embodiment handle 80 is attached to housing 52 by inserting a first end 82 of handle 80 through a hole in a sidewall 53 of housing 52, and a second end 84 of the handle through a hole in an opposing sidewall 53. In one embodiment of handle 80, first and second ends 82, 84, respectively, of handle 80 have a length sufficient to extend through the holes in sidewalls 53 and between two adjacent coils of the tubing 58. Alternatively, first and second ends 82 and 84, respectively are long enough to extend through the holes in the particular side wall 53 of housing 52 and past the inside diameter of coiled tubing 58. However, in this embodiment, by way of example and not limitation, first end 82 and second end 84 are on opposing ends of handle 80 and are not connected. In this particular embodiment first end 82 and second end 84 of handle 80 are retained therein by conventional movable attachment methods.

Advantageously, in these embodiments first and second ends 82 and 84, respectively, of handle 80 help position and secure coiled tubing 58 within the housing Of course, one skilled in the art will appreciate that handle 80 may be attached to the housing 52 in a variety of ways well known in the art. It will also be appreciated that various other configurations of handle 80 are capable of caring out the function thereof. For example, first and second ends 82 and 84, respectively, are not required to extend past the inner diameter of coiled tubing 58. In fact, in another embodiment, first and second ends 82 and 84, respectively, of handle 80 may only extend just past side wall 53 of housing 52.

Housing 52 also includes an upper inner surface 86, as shown in FIG. 6, disposed near the top of housing 52. In one embodiment of portable water heater 10, inner surface 86 includes brackets 88 that help hold coiled tubing 58 in the desired position. As illustrated, in one embodiment, two brackets 88 are used to hold coiled tubing 58 in place. It will be appreciated that various other numbers of brackets 88 could be utilized to hold coiled tubing 58 in place. It will also be appreciated by one skilled in the art that various other fastening or retaining methods could be used in housing 52 to retain coiled tubing 58 in position.

Housing 52 of heating assembly 50 also includes a plurality of apertures 90 disposed in the upper portion of sidewalls 53 to allow the flow of air and gas to exit heating assembly 50 which will be discussed in further detail. Additionally, in one embodiment housing 52 has a generally flat, planar upper surface 92 that advantageously allows items to be placed on upper surface 92 of heating assembly 50. Advantageously, food, small articles of clothing, or other objects may be heated on upper surface 92 of housing 52 while portable water heater 10 is operating. Upper surface 92 also helps to prevent rain and other items from entering heating assembly 50 when the portable water heater is being used outdoors. In alternative embodiment shown in FIG. 7, housing 252 has an upper surface 292 is that removably attached to the housing 252.

It will be appreciated that while apertures 90 are depicted as being round in one embodiment, apertures 90 may have various other shapes and configurations. By way of example and not limitation, apertures 90 may be oval, elliptical, octagonal, square, rectangular, or the like, or any combination thereof. In addition, it is contemplated that upper surface 92 may have apertures 90 formed therein.

Returning to FIG. 2, attached to the lower portion of housing 52 of heating assembly 50 is a heat source 100 that includes a fuel source 102. Fuel source 102 is preferably a container or tank of combustible gas, such as propane, but other suitable types of fuel may also be used. In one embodiment, the container for fuel source 102 is a pressurized cylinder of gas that contains about 16.4 ounces of fuel, but it may contain any desirable amount of gas depending upon the intended use of the portable water heater 10. It will be appreciated that various other sizes of containers for fuel source 102 may be utilized. It is contemplated that the size of fuel sources that are readily available can be utilized. In addition, various other sizes of containers may be used. By way of example and not limitation, the container of fuel source 102 may include up to five gallons, or more, of gas for extended use of portable water heater 10 in a remote cabin or at a large campsite with numerous people. Similarly, it is contemplated that the container for fuel source 102 may be of the style often used for campers, barbeques and the like. Alternatively, the container for fuel source 102 may include only a few ounces of gas for use by backpackers, hikers and mountain climbers.

Figure 3:
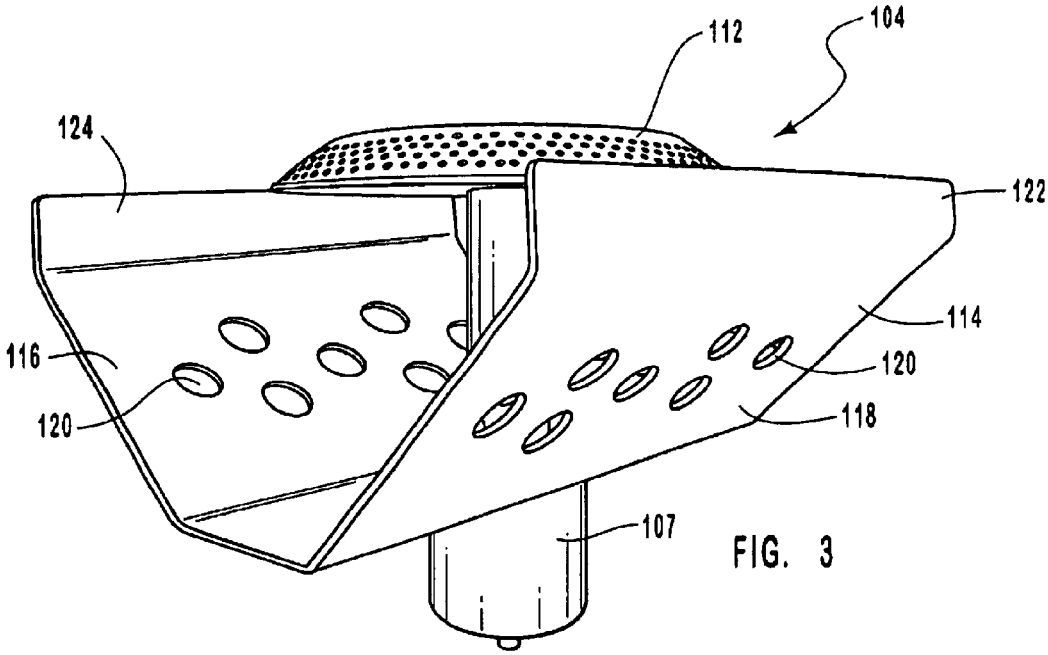
FIG. 3 is a perspective view of a portion of the portable water heater shown in FIG. 1, illustrating one embodiment of a fuel burner assembly.

As illustrated in FIG. 3, in one embodiment heat source 100 also includes a fuel burner assembly 104, which combusts fuel to create heat in heating assembly 50. FIGS. 3, depicts one embodiment of fuel burner assembly 104. As illustrated in FIG. 3, in one embodiment fuel burner assembly 104 includes a connector 107 which connects fuel burner assembly 104 to fuel source 102 (see FIG. 1).As illustrated in FIG. 3, connector 107 connects fuel source 102 (see FIG. 1) to a fuel conduit 108.

Turning now to FIGS. 5 and 6, in one embodiment fuel conduit 108 has a first end 108A and a second end 108B. Second end 107B of connector 107 is attached to first end 108A of fuel conduit 108. Fuel conduit 108 also includes openings 113 that are spaced about fuel conduit 108 to allow air to be mixed with the fuel to promote efficient burning of the fuel. In one embodiment, fuel conduit 108 has four openings 113 formed therein. It will be appreciated by one skilled in the art that various other numbers of openings 113 could be utilized to carry out the function thereof. Further, in one embodiment, openings 113 are equally spaced about the circumference of fuel conduit 108. It will be appreciated that various other configurations of openings 113 may be utilized to carry out the intended function thereof. Openings 113 arc intended to allow a quantity of air to mix with the fuel to achieve efficient burning of the fuel. Accordingly, openings 113 are sized and configured to create the proper air-fuel mixture for efficient combustion of the fuel.

Burner 112 is attached to the second end of fuel supply tube 108 and includes a plurality of openings to release the fuel-air mixture where the flame will occur. Fuel burner assembly 104 is connected to fuel source 102 (not shown) by a connector 107. As illustrated most clearly in FIG. 6, in one embodiment, connector 107 is connected to fuel source 102 (not shown) by threads that allows fuel burner assembly 104 to be releasably connected to fuel source 102. Connector 107 includes a control valve 110 that controls the flow of fuel from fuel source 102 to fuel burner assembly 104. Control valve 110 has a control knob 110A attached thereto and is disposed in connector 107 to selectively control the flow of fuel through connector 107. A needle 105 extends from connector 107 into the outlet of fuel source 102 (not shown) to enable fuel from the fuel source to flow into connector 107.

FIG. 7 illustrates another embodiment of fuel burner assembly 104. In this embodiment burner 212 is configured to extend vertically along the central axis of coiled tubing 258 disposed in one embodiment of heating assembly 250 and housing 252. One advantage of this embodiment is that because one or more of sections of the coils of coiled tubing 258 decrease in diameter as coiled tubing 258 spirals upwardly, at grater portion of coiled tubing 258 are directly exposed to the heat from burner 212. In other words, where coiled tubing 258 is configured as illustrated in FIG. 7, least some if not all of the lower and upper coils of coiled tubing 258 are directly exposed to the heat from the burner 212.

A shield 114 is attached to fuel conduit 108. In one embodiment, shield 114 includes two opposing, upwardly extending sidewalls 116, 118. In one embodiment, sidewalls 116 and 118 are extending angularly away from each other in an upward direction. It will be appreciated that sidewalls 116 and 118 could be oriented in different configurations. By way of example and not limitation, shield 114 may have sidewalls 116 and 118 which extend substantially vertically upward. Accordingly, shield 114 could be shaped as an open box-like structure.

In one embodiment of shield 114 depicted in FIGS. 3 and 6, sidewalls 116, 118 of shield 114 include a plurality of openings 120 to allow air to be introduced into heating assembly 50. It will be appreciated that while openings 120 are in one embodiment depicted as being round, openings 120 may have various other shapes such as being oval, elliptical, square, rectangular, octagonal or the like or combinations thereof. In one embodiment, shield 114 also includes open opposing ends 122, 124 to allow additional air to be introduced into heating assembly 50. Advantageously, shield 114 allows a large quantity of air to be introduced into heating assembly 50 while also protecting burner 112 from damage and generally preventing the user or other objects from touching the burner or contacting the burning gas.

In one embodiment, shown in FIG. 5, the upper portions of sidewalls 116, 118 of shield 114 are separated by generally the same distance as sidewalls 53 of housing 52 such that heat source 100 can be readily attached to heating assembly 50. As a result, the upper portions of sidewalls 116, 118 of are configured to be inserted into corresponding flanges 126, 128 in housing 52 to create a friction engagement of heat source 100 to heating assembly 50. It will be appreciated that various other ways of attaching shield 114 to housing 52 could be utilized.

By way of example and not limitation, sidewalls 116, 118 of shield 114 may be either slightly compressed or expanded to create a more secure connection of heat source 100 to heating assembly 50. As illustrated in FIG. 2, in one embodiment, flanges 126, 128 of housing 52 may include one or more inwardly extending bumps or protrusions 129 that engage sidewalls 116, 118 of shield 114 (see FIG. 5). Advantageously, this friction and/or compression engagement of heat source 100 and heating assembly 50 creates a secure, but releasable connection that allows portable water heater 10 to be easily assembled and disassembled. Alternatively, in another embodiment heat source 100 and heating assembly 50 are connected by any suitable means well known in the art such as rivets, screws, hinges, welding, glue, and the like.

Advantageously, heating assembly 50 and heat source 100 efficiently heat the water traveling through coiled tubing 58 because burner 112 is located near coiled tubing 58. Further, in one embodiment, because one or more of the coils of tubing 58 decrease in diameter as coiled tubing 58 spirals upwardly, at least some if not all of the lower and upper coils 58 are directly exposed to the heat from burner 112. Alternatively, where coiled tubing 58 forms a generally cylindrical shaped body, coiled tubing 58 allows the heat from burner 112 to flow upwardly past the coils without being impeded.

Shield 114 also increases the efficiency of portable shower heater 10 by directing the heat from burner 112 toward coiled tubing 58. More specifically, in one embodiment, angled sidewalls 116, 118 of shield 114, which is constructed from metal, assist in directing the heat from burner 112 towards coiled tubing 58, and housing 52, which is constructed from metal, also helps direct the heat from burner 112 to coiled tubing 58. It will be appreciated that various types of materials capable of withstanding heat may be utilized as the coiled tubing 58 and/or housing 52.

In one embodiment, illustrated in FIG. 6, upper inner surface 86 of housing 52 helps retain the heat from burner 112 within in the housing while allowing the combustion gases to escape through the apertures 90 near the top of sidewalls 53 of housing 52. Thus, heating assembly 50 provides for efficient heating of the water due to the effective heat transfer from the heat source to the water, and the loss of heat from heating assembly 50 is minimized.

Referring to FIG. 2, an outlet assembly 130 is attached to the upper portion of heating assembly 50 to allow the water to flow from the coiled tubing 58 into an outlet conduit 132. More specifically, outlet conduit 132 is connected to outlet 60. In one embodiment, outlet conduit 132 is comprised of a resilient, flexible material. It will be appreciated that outlet conduit 132 may have various configurations and perform the function thereof. A fixture 134, such as a showerhead, may be attached to outlet conduit 132 depending upon the intended use of water heater 10. It will be appreciated that other suitable types of fixtures 134, or no fixture at all, may be used depending upon the intended use of portable water heater 10.

The portable water heater 10 may also include a carrying case (not shown) that allows the device to be easily transported and assembled. The carrying case desirably allows all the components of portable water heater 10 to be stored when it is not in use. Advantageously, the carrying case can also be used to store and contain water for the water heater 10. That is, the carrying case can be filled with water to serve as water source 11 for portable water heater 10.

In greater detail, the carrying case preferably includes a recessed handle and a removable lid. The removable lid is preferably releasable attached to a body of the carrying case by two or more hinges that allow the lid to be removed. The removable lid includes a recessed portion or cavity that is sized and configured to receive all or a portion of water heater 10. In one embodiment, the recessed portion is sized and configured to receive and hold one or more pressurized gas cylinders in an upright position. Advantageously, the lid provides a sturdy and stable base for portable water heater 10, whether or not the lid is attached to the body of the carrying case. A preferred embodiment of the carrying case is disclosed in co-pending U.S. provisional patent application Ser. No. 60/312,550, filed on Aug. 15, 2001, which was converted into a U.S. patent application Ser. No. 10/222,732, filed on Aug. 15, 2002, which is hereby incorporated by reference in its entirety.

As illustrated in FIGS. 1–3, in order to assemble portable water heater 10, fuel burner assembly 104 with gas burner 112 is connected to fuel source 102, such as a pressurized cylinder 106 filled with propane. In particular, fuel conduit 108 allows fuel burner assembly 104 to be quickly and easily connected to the pressurized cylinder that is the fuel source 102 by simply screwing or twisting fuel burner assembly 104 on to fuel source 102. Heating assembly 50 may then be connected to heat source 100 by a friction and/or compression fit. In one embodiment, housing 52 of heating assembly 50 includes a pair of flanges 126, 128 that allow heat source 100 to be securely fastened to heating assembly 50. Alternatively, heating assembly 50 and heat source 100 may be permanently connected by means such as by riveting or welding. One skilled in the art will appreciate that portable water heater 10 can also be assembled in other desired sequences and orders.

In operation, intake 12 is inserted into or connected to water source 11 such that water is provided to portable water heater 10, and power is supplied to pump 20 by power supply 30. For example, the user can insert intake 12 and pump 20 into a bucket of water as shown in FIG. 1, and the user can depress the on/off switch 38 on power supply 30 to turn pump 20 on and draw water from water source 11 through intake 12. The user then turns on heat source 100 by opening gas control valve 110 and igniting the gas either manually or automatically. Thus, water is now flowing through water heater 10 and the water is being heated by heat source 100. One skilled in the art will appreciate that the volume of water being pumped is generally dependent upon the size and speed of the pump. Thus, the speed or size of the pump can be increased to supply a larger volume of water.

In greater detail, the water flows through pump 20, intake tube 40, intake 12, and into heating assembly 50 where the water enters heat transfer conduit 56. As the water traverses heat transfer conduit 56, heat from heat source 100 heats the water. In particular, coiled tubing 58 absorbs the heat from heat source 100, and transfers the heat to the water as it flows through coiled tubing 58. In one embodiment coiled tubing 58 spirals upwardly and has a decreasing diameter, such that the coils assume a conical shape, exposing at least some of the upper coils directly to the heat from heat source 100. Advantageously, this configuration increases the transfer of heat from heat source 100 to the water because more of the coils are heated to a higher temperature. Additionally, as discussed above, coiled tubing 58 is spaced apart to facilitate heating of coiled tubing 58 and to allowing hot air and gases to flow around coiled tubing 58. This arrangement further increases the heat transfer between the heat source 100 and coiled tubing 58. Advantageously, because heat transfer conduit 56 has a large surface area, is located proximate to heat source 100, and is constructed from materials that facilitate the transfer of heat, the water is quickly and efficiently heated. In one embodiment, coils are formed in a generally cylindrical shape. In this embodiment heating of the water is obtained efficiently because of the large surface area, proximity to heat source 100 and is constructed from materials made to efficiently transfer heat.

The heated water then exits heating assembly 50 through outlet 60 and enters outlet assembly 130. More specifically, water enters outlet conduit 132. Outlet conduit 132 is connected to any suitable fixture 134, such as a showerhead, which can be used for any desirable task or undertaking such as taking a shower.

Once hot water from water heater 10 is no longer needed, the user simply extinguishes heat source 100 by turning control valve 110 into the off position and turning pump 20 off. Extinguishing heat source 100 stops the heating of the water, and turning off pump 20 stops the flow of water through water heater 10. The user can then detach intake tube from either pump 20 or inlet 54 and allow the water to drain from portable water heater 10. Portable water heater 10 is now ready to be disassembled, moved or transported. Advantageously, portable water heater 10 can also be quickly disassembled for storage or transport. For example, heating assembly 50 can be disconnected from heat source 100, and fuel burner assembly 104 can be disconnected from fuel source 102. This disconnected state allows the various components to be stored in a relatively small area, such as inside the carrying case.

Although the present invention has been described in terms of certain preferred embodiments, other embodiments apparent to those skilled in the art are also within the scope of the invention. Thus, the described preferred embodiments are to be considered in all respects only as illustrative and not restrictive. Accordingly, the scope of the invention is intended to be defined only by the following claims. All changes that come within the meaning and range of equivalency of the claims are to be embraced within their scope.

What is claimed is:

1. A portable water heater for providing a continuous flow of hot water by heating the water as it flows to the user for immediate use, the portable water heater comprising:

a fuel burner configured to produce heat as fuel is burned;

a heat transfer conduit fluidly connected to a water source, said heat transfer conduit being configured to transfer the heat produced by said fuel burner to the water flowing through said heat transfer conduit;

a heat shield connected to the fuel burner, the heat shield including at least one sidewall and the heat shield being sized and configured to facilitate heat transfer from the fuel burner to the heat transfer conduit;

a connector that is sized and configured to mechanically couple the heat shield to a housing disposed about the heat transfer conduit, the connector selectively connecting the heat shield and the housing by frictional engagement to allow the heat shield and the housing to be attached and detached; and a pump being sized and configured to pump water through said heat transfer conduit with sufficient force to allow a user to take a shower, said pump being disposed within the water of the water source.

2. The portable water heater of claim 1, wherein said heat transfer conduit comprises at least one coiled tube.

3. The portable water heater of claim 2, wherein at least a portion of said coiled tubing forms a cylindrical shaped member.

4. The portable water heater of claim 2, wherein said coiled tubing forms a substantially conical shaped member.

5. The portable water heater of claim 1, wherein said heat transfer conduit comprises a first portion disposed proximate to said fuel burner and a second portion disposed remote from said fuel burner.

6. The portable water heater of claim 5, wherein said first portion of said heat transfer conduit has a diameter is larger than the diameter of said second portion.

7. The portable water heater of claim 1, wherein said heat transfer conduit comprises a plurality of coils, said plurality of coils comprising a first coil disposed proximate to said fuel burner with an inner diameter that is larger than an inner diameter of a coil disposed remote to said fuel burner.

8. The portable water heater of claim 1, wherein said heat transfer conduit comprises a heat conductive material.

9. The portable water heater of claim 8, wherein said heat transfer conduit comprises copper.

10. The portable water heater of claim 1, wherein said heat transfer conduit is located substantially proximate to said fuel burner so as to transfer heat from the combustion of the fuel to said heat transfer conduit which in turn heats the water traveling there through.

11. The portable water heater of claim 1, wherein said heat transfer conduit comprises a plurality of generally vertically aligned coiled tubing.

12. A portable water heater of claim 11, wherein said heat transfer means is fluidly connected to an outlet line through which water exits said portable heater for use by a user.

13. A portable water heater for providing a continuous flow of hot water by heating the water as it flows to the user for immediate use, the portable water heater comprising:

a fuel burner configured to produce heat as fuel is burned;

heat transfer means for transferring heat from said fuel burner to the water flowing through the heat transfer means, said heat transfer means being fluidly connected to a water source;

a heat shield connected to the fuel burner, the heat shield including at least one sidewall that is sized and configured to be removably attached to a housing disposed about the heat transfer means by connecting means including frictional engagement of the sidewall and the housing, the heat shield being sized and configured to facilitate heat transfer from the fuel burner to the heat transfer means and to allow the fuel burner to be selectively connected to the housing; and a pump fluidly connected to said heat transfer means, said pump being fluidly connected to the water source as said pump is disposed in water of the water source, said pump being sized and configured to pump water through said heat transfer means.

14. The portable water heater of claim 12, wherein said fuel burner is located substantially proximate to paid heat transfer means so as to allow said heat transfer means to transfer the heat from the combustion of the fuel to the water traveling through said heat transfer means.

15. The portable water heater of claim 13, wherein said heat transfer means comprises a heat transfer conduit.

16. The portable water heater of claim 13, wherein said heat transfer means comprises coiled tubing.

17. The portable water heater of claim 16, wherein said coiled tubing is generally centrally disposed about a vertical axis.

18. A portable water heater for providing a continuous flow of hot water by heating the water as it flows to the user for immediate use, the portable water heater comprising:

a fuel burner configured to produce heat as fuel is burned;

a pump fluidly connected to a water source as said pump is disposed within water of the water source; and a heating assembly attached to said pump, said heating assembly comprising a housing and a heating conduit disposed in said housing, said heating conduit being fluidly connected to said pump, said heating conduit being configured to transfer the heat produced by said fuel burner to the water flowing through said heating conduit, said heating conduit being positioned proximate to said fuel burner;

a heat shield connected to the fuel burner, the heat shield including at least one sidewall and the heat shield being sized and configured to facilitate heat transfer from the fuel burner to the heat transfer conduit; and a connector that is sized and configured to mechanically couple the heat shield to a housing disposed about the heat transfer conduit, the connector selectively connecting the heat shield and the housing by frictional engagement to allow the heat shield and the housing to be attached and detached.

19. The portable water heater of claim 18, wherein said heating conduit comprises coiled tubing.

20. The portable water heater of claim 18, wherein said heating conduit is a cylindrical shaped member disposed about a vertical axis in said housing.

21. The portable water heater of claim 18, wherein said heating conduit is a conical shaped member disposed about the vertical axis in said housing.

22. The portable water heater of claim 18, further comprising a fuel burner assembly which comprises said fuel burner, said fuel burner assembly being releasably connected to said heating assembly.

23. The portable water heater of claim 18, wherein said housing comprises an upper surface that is substantially planar, said upper surface providing a surface for heating items while the portable water heater is in use.

24. A portable water heater for providing a continuous flow of hot water by heating the water as it flows to the user for immediate use, the portable water heater comprising:

a fuel burner configured to produce heat as fuel is burned;

a heat transfer conduit fluidly connected to a water source, said heat transfer conduit comprises at least one coil, said at least one coil being configured to transfer the heat produced by said fuel burner to the water flowing through said heat transfer conduit;

a heat shield connected to the fuel burner, the heat shield including at least one sidewall and the heat shield being sized and configured to facilitate heat transfer from the fuel burner to the teat transfer conduit;

a connector that is sized and configured to mechanically couple the heat shield to a housing disposed about the heat transfer conduit, the connector selectively connecting the heat shield and the housing by frictional engagement to allow the heat shield and the housing to be attached and detached; and a pump being sized and configured to pump water through said at least one coil of said heat transfer conduit with sufficient force to allow a user to take a shower, said pump being disposed within water of the water source.

25. The portable water heater of claim 24, wherein said at least one coil has an inlet through which water enters and an outlet through which heated water exits.

26. A portable water heater comprising:

an intake assembly;

a water pump fluidly connected to the intake assembly;

a power supply electrically connected to the water pump;

a heating assembly that is separate and spaced apart from the intake assembly, the heating assembly comprising:

a first portion including an inlet fluidly connected to the intake assembly by a conduit; and a second portion including a gas transfer assembly with a plurality of openings to facilitate gas flow;

a heat transfer conduit disposed within the first portion of the heating assembly, the heat transfer conduit including coiled tubing; and a heat source detachably connected to the heating assembly by one or more connectors, at least a portion of the heat source being disposed within the first portion of the heating assembly when the heat source is attached to the heating assembly the heat source including a shield with one or more angled sidewalls, the angled sidewalls being detachably connected to the heating assembly.

27. The portable water heater as in claim 26, wherein the angled sidewalls are sized and configured to facilitate beat transfer from the heat source to the heating assembly.

28. The portable water heater as in claim 26, further comprising a plurality of openings in the angled sidewalls of the shield to allow air to flow to the heat source.

29. The portable water heater as in claim 26, wherein the heat source includes a shield with at least a first sidewall and an opposing second sidewall, the first sidewall and second sidewall of the shield being sized and configured to facilitate heat transfer from the heat source to the heating assembly, the first sidewall and the second sidewall being sized and configured to be detachably connected to the heating assembly.

30. The portable water heater as in claim 26, further comprising an outlet connected to the first portion of the heating assembly, the outlet being fluidly connected to an outlet assembly by a conduit.

31. The portable water heater as in claim 26, wherein the power supply is separate and spaced apart from the rump to facilitate remote operation of the pump.

32. The portable water heater as in claim 26, wherein the coiled tubing in the heat transfer conduit includes at least a first set of coiled tubing with a first diameter and a second set of coiled tubing with a second diameter that is smaller than the first diameter.

33. The portable water heater as in claim 26, wherein the heat source is detachably connected to the heating assembly by a friction fit.

34. The portable water heater as in claim 26, wherein the first portion of the heating assembly is spaced apart from the second portion of the heating assembly.

35. The portable water heater as in claim 26, wherein the pump and the intake assembly are part of a unitary, one-piece assembly.

* * * * *

UNITED STATES PATENT AND TRADEMARK OFFICE

CERTIFICATE OF CORRECTION

PATENT NO. : 6,978,496 B2
APPLICATION NO. : 10/216496
DATED : December 27, 2005
INVENTOR(S) : Adrian It is certified that error appears in the above-identified patent and that said Letters Patent is hereby corrected as shown below:

Column 5
Line 32, remove “used”

Column 6
Line 1, after “damage” remove “,”
Line 9, after “container” insert --,--
Line 35, change “could by” to --could be--
Line 45, after “pump” change “30” to --20--

Column 7
Line 46, after “tube” insert --58--
Line 54, after “one” insert --embodiment--
Line 55, change “attache” to --attach--
Line 58, after “thereof” insert --.--

Column 8
Line 12, change “68” to --70--
Line 23, after “70” insert --of--

Column 9
Line 5, after “conical” insert --,--
Line 12, change “May” to --may--
Line 45, after “housing” insert --52.--

Column 10
Line 11, before “alternative” insert --an--
Line 45, change “FIGS. 3” to --FIG. 3--
Line 54, remove “107B”
Line 66, change “arc” to --are--

Column 11
Line 15, remove “105”
Line 26, change “at grater” to --a greater--
Line 26, change “are” to --is--
Line 28, before “least” insert --at--

Column 13
Line 18, remove “106”
Lines 48 & 49, change “pump 20, intake tube 40, intake 12” to --intake 12, pump 20, intake tube 40--
Line 62, change “allowing” to --allow--

UNITED STATES PATENT AND TRADEMARK OFFICE

CERTIFICATE OF CORRECTION

PATENT NO. : 6,978,496 B2
APPLICATION NO. : 10/216496
DATED : December 27, 2005
INVENTOR(S) : Adrian It is certified that error appears in the above-identified patent and that said Letters Patent is hereby corrected as shown below:

Column 14
Line 11, after "undertaking" insert --,--

Column 15
Line 51, change "paid" to --said--
Line 67, remove "and"

Column 17
Line 12, after "assembly" insert --,--
Line 17, change "beat" to --heat--

Signed and Sealed this

Seventh Day of August, 2007

JON W. DUDAS
*Director of the United States Patent and Trademark Office*